US010030455B2

(12) United States Patent
Meuth et al.

(10) Patent No.: US 10,030,455 B2
(45) Date of Patent: Jul. 24, 2018

(54) SKATE DRIVE AND TUBULAR CLAMPING SYSTEM FOR A CATWALK

(71) Applicant: FORUM US, INC., Houston, TX (US)

(72) Inventors: Joshua Brandon Meuth, Giddings, TX (US); Timothy Sherbeck, Katy, TX (US); Aaron Bryant, Tornball, TX (US)

(73) Assignee: FORUM US, INC, Houston, TX (US)

( * ) Notice: Subject to any disclaimer, the term of this patent is extended or adjusted under 35 U.S.C. 154(b) by 81 days.

(21) Appl. No.: 15/154,973

(22) Filed: May 14, 2016

(65) Prior Publication Data

US 2017/0328148 A1 Nov. 16, 2017

(51) Int. Cl.

| | |
|---|---|
| ***E21B 19/00*** | (2006.01) |
| ***E21B 19/15*** | (2006.01) |
| ***E21B 19/14*** | (2006.01) |

(52) U.S. Cl.

CPC ..... *E21B 19/15* (2013.01); *E21B 19/14* (2013.01)

(58) Field of Classification Search

CPC ..... E21B 19/155; E21B 19/15; E21B 19/14; E21B 19/20

USPC ..... 414/22.51–22.71; 294/86.27, 86.28, 294/86.31, 197

See application file for complete search history.

(56) References Cited

U.S. PATENT DOCUMENTS

| | | | | |
|---|---|---|---|---|
| 2,537,607 | A * | 1/1951 | Stone | E21B 19/14 294/104 |
| 3,949,620 | A * | 4/1976 | Zehnder | F15B 15/02 74/110 |
| 4,332,411 | A * | 6/1982 | Ellzey | E21B 19/155 294/104 |
| 7,832,974 | B2 | 11/2010 | Fikowski et al. | |
| 8,801,356 | B2 | 8/2014 | Gerber | |
| 2006/0285941 | A1 | 12/2006 | Fikowski et al. | |
| 2009/0196711 | A1 | 8/2009 | Gerber et al. | |
| 2012/0121364 | A1 | 5/2012 | Taggart et al. | |
| 2013/0266404 | A1* | 10/2013 | Tolman | E21B 19/15 414/22.59 |
| 2014/0286732 | A1 | 9/2014 | Swanson et al. | |
| 2016/0251916 | A1* | 9/2016 | Arbelaez | E21B 19/155 414/22.59 |

OTHER PUBLICATIONS

International Search Report and Written Opinion dated Sep. 7, 2017, corresponding to Application No. PCT/US2017/026441.

* cited by examiner

*Primary Examiner* — Anna M Momper
*Assistant Examiner* — Lynn E Schwenning
(74) *Attorney, Agent, or Firm* — Patterson + Sheridan, L.L.P.

(57) ABSTRACT

A skate drive and tubular clamping system for a catwalk. The system includes first and second actuators configured to move a skate and a clamp. The system includes a biasing device coupled to the skate and configured to bias the clamp between and open and clamped position based on a tension force between forces applied by the first and second actuators and a clamping threshold force. The first and second actuators may be flexibly coupled to the skate drive and tubular clamping system, such as by cables, and remotely mounted on a trough of the catwalk.

19 Claims, 7 Drawing Sheets

SKATE DRIVE AND TUBULAR CLAMPING SYSTEM FOR A CATWALK

BACKGROUND

Field

Embodiments of the disclosure generally relate to catwalks for conveying pipe and other tubulars to a drill floor from a lower section of a drilling rig or drill site. Specifically, embodiments of the disclosure relate to a streamlined skate drive and tubular clamping system for catwalks.

Description of the Related Art

In a drilling operation or rig work-over operation, whether on a water-based or land-based drilling rig, pipe for the drilling operation, casing, or other tubulars are often stored at or supplied from a pipe deck at a level that is lower than the drill floor. Operators typically use a "catwalk" to convey the pipe from the pipe deck to the drill floor, and to return pipe to the pipe deck after use. The catwalk typically has a trough that holds the pipe when being transferred to and from the drill floor. The pipe is typically mechanically transported (e.g. pushed with a skate and/or pulled in the trough) from a level below the rig floor to the rig floor.

Prior art catwalks use a skate drive system having multiple actuating components positioned on either side of a trough of the catwalk, such as rack and pinion skate drives, along which a skate is moved to push and/or pull pipe. Some prior art systems also have complex tubular clamping systems that trail the skate as it moves along the trough and which require additional actuating components dedicated solely to the tubular clamping system. Such prior art systems are costly, add weight to the catwalk, and are difficult to operate over the entire length of the trough.

Accordingly, it would be useful to have a more streamlined skate drive and tubular clamping system for catwalks.

SUMMARY

A skate drive and tubular clamping system for a catwalk comprising a skate configured to move a tubular along a trough of the catwalk; a clamp configured to clamp the tubular to the skate; a first actuator having a first moving member coupled to a first connection member by a first cable; a second actuator having a second moving member coupled to a second connection member by a second cable, wherein the first and second actuators are configured to extend and retract the first and second moving members to move the skate and the clamp via the first and second cables along the trough; and a biasing device coupled to the clamp and configured to move the clamp between an open position and a clamped position based on a tension force applied between the first and second cables and a clamping threshold force applied to the clamp by the biasing device.

A method of remotely and independently operating a skate drive and tubular clamping system comprises actuating at least one of first and second actuators to generate a differential force between the first and second actuators to move a skate along a trough of a catwalk, wherein the first and second actuators are coupled to the skate by first and second cables; moving a clamp to an open position by applying a clamping threshold force to the clamp; and moving the clamp from the open position to a clamped position to clamp a tubular to the skate when a tension force applied to the first and second cables exceeds the clamping threshold force.

BRIEF DESCRIPTION OF THE DRAWINGS

The appended drawings illustrate only typical embodiments and are therefore not to be considered limiting of the scope of the disclosure.

DETAILED DESCRIPTION

Figure 1:
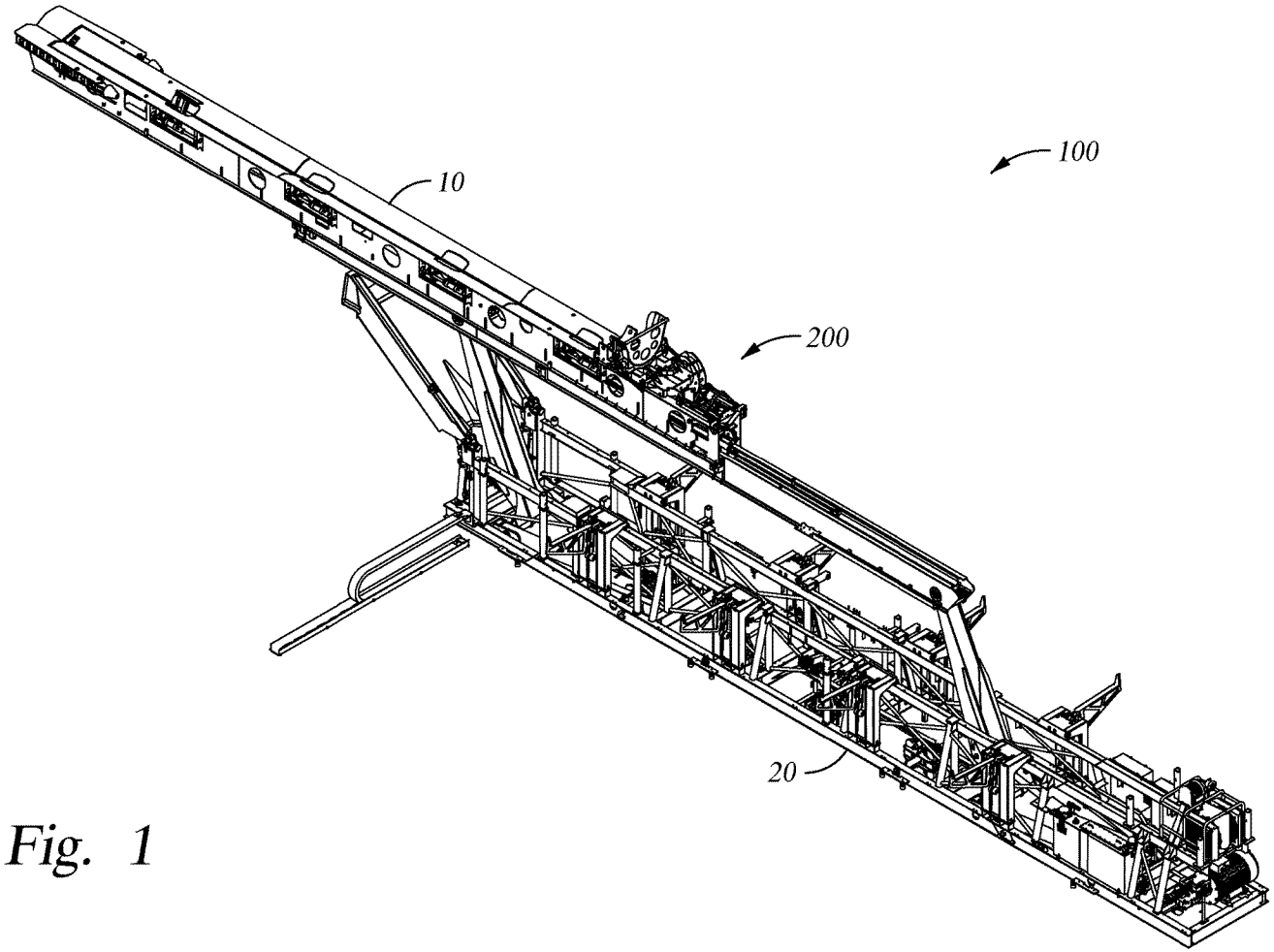
FIG. 1 shows a catwalk in a raised position.

FIG. 1 shows a catwalk 100 having a trough 10 in a raised position that is supported by a frame 20, according to one embodiment. The catwalk 100 is configured to convey tubulars, such as pipe, between a lower pipe deck level or ground level, and a higher rig floor level. The pipe is pushed along the trough 10 by a skate drive and tubular clamping system 200 when removing the pipe from the trough 10 onto the higher rig floor level. The pipe is pulled by the skate drive and tubular clamping system 200 when placing the pipe back into the trough 10 from the higher rig floor level.

Figure 2:
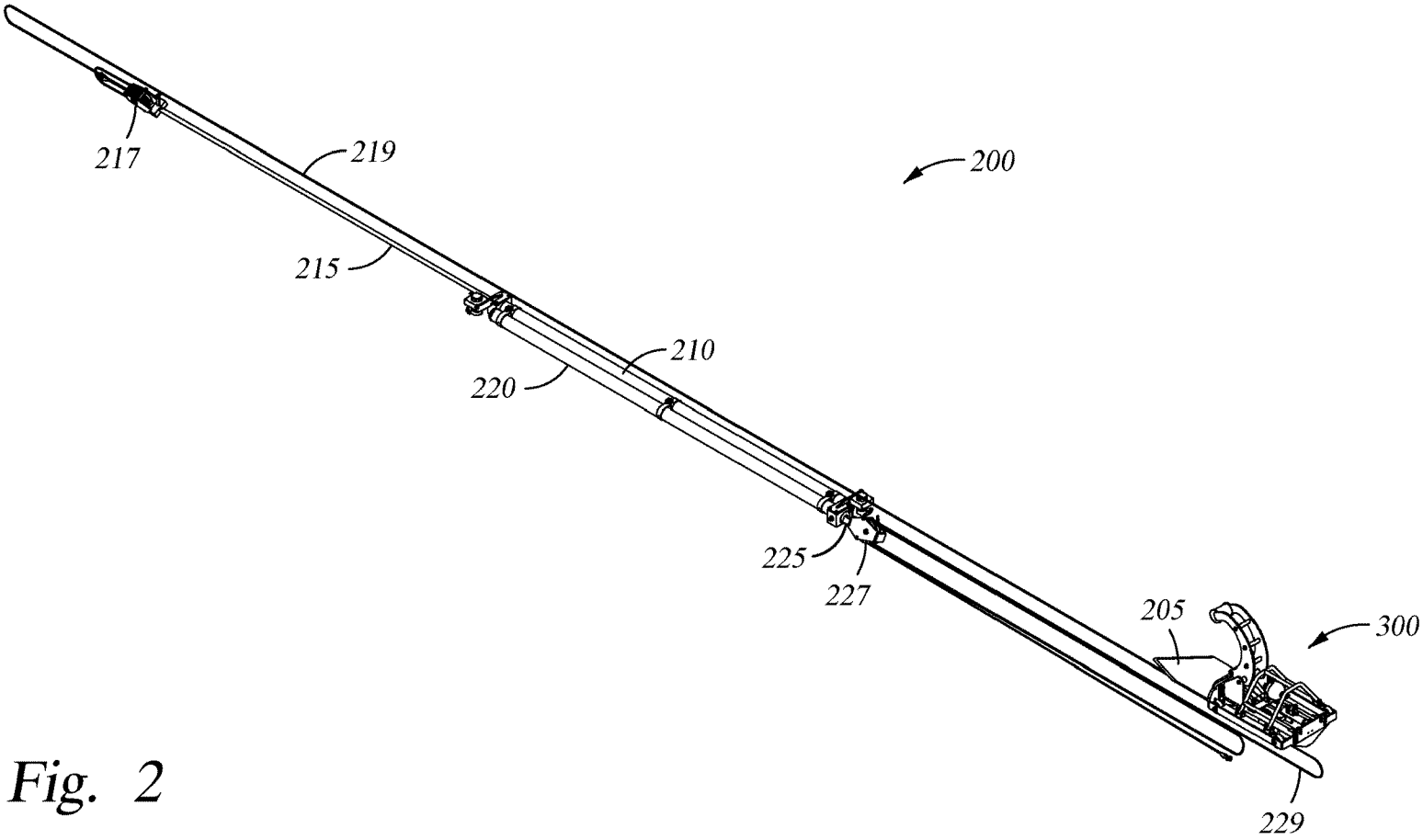
FIG. 2 shows a perspective view of a skate drive and tubular clamping system according to one embodiment.
Figure 3A:
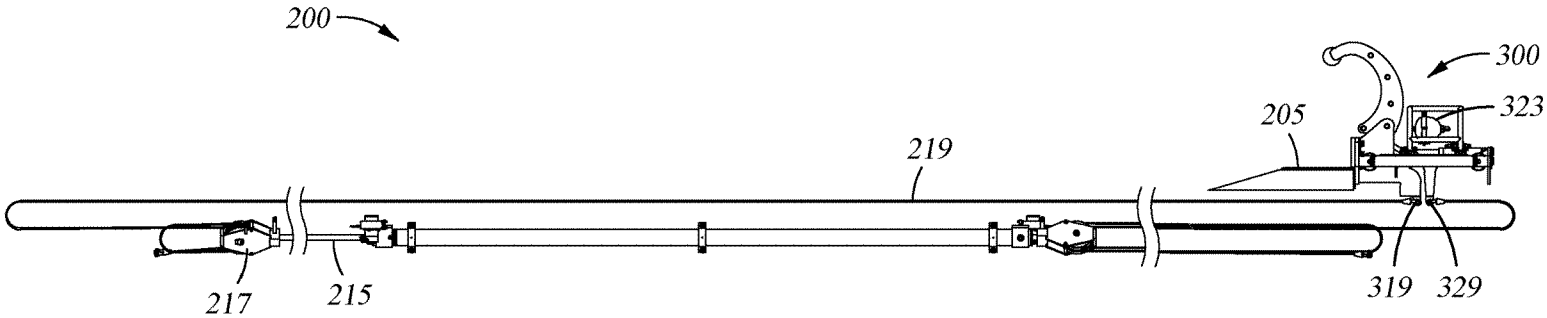
FIG. 3A shows a side view of the skate drive and tubular clamping system.
Figure 3B:
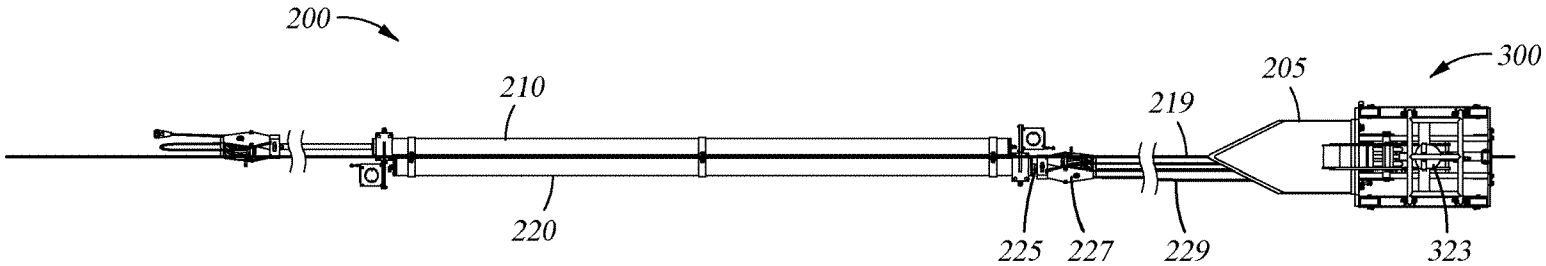
FIG. 3B shows a top view of the skate drive and tubular clamping system.

FIG. 2 shows a perspective view of the skate drive and tubular clamping system 200 with the trough 10, the frame 20, and other components of the catwalk 100 removed for clarity. FIG. 3A shows a side view of the skate drive and tubular clamping system 200 shown in FIG. 2. FIG. 3B shows a top view of the skate drive and tubular clamping system 200 shown in FIG. 2. The components of the skate drive and tubular clamping system 200 discussed below are centrally located along the center axis of the trough 10, which provides a more streamlined arrangement and helps reduce the overall weight and complexity of the catwalk 100.

Referring to FIGS. 2, 3A, and 3B, the skate drive and tubular clamping system 200 includes a skate 205 configured to push or pull a pipe along the trough 10. The skate drive and tubular clamping system 200 further includes a clamping assembly 300 configured to clamp the pipe to the skate 205 so that the pipe moves with the skate 205 along the trough 10. The skate 205 is coupled to the clamping assembly 300 such that they move together during operation. The skate 205 may move along the trough 10 with the clamping assembly 300 in either an open position or a clamped position as further described below.

The system 200 includes a first actuator 210 having a first moving member 215, such as a rod, coupled to a first connection member 319 of the system 200 by a first cable 219. One end of the first cable 219 is coupled to the first connection member 319 and the opposite end of the first cable 219 is coupled to the trough 10. The first cable 219 wraps around at least a first sheave 217 that is coupled to the first moving member 215 and may wrap around any other number of sheaves positioned between the first connection member 319 and the trough 10 to help move the skate 205 along the trough 10. The first actuator 210 can be a hydraulic cylinder as shown in this embodiment, or can be another type of linear actuator or a rotary actuator, such as a winch. In any case, the first actuator 210 is flexibly coupled to the skate 205 using cables and sheaves, such as the first cable 219 and first sheave 217, another type of pulley system, and/or other similar types of connection systems.

The system 200 further includes a second actuator 220 having a second moving member 225, such as a rod, coupled to a second connection member 329 of the system 200 by a second cable 229. One end of the second cable 229 is coupled to the second connection member 329 and the opposite end of the second cable 229 is coupled to the trough 10. The second cable 229 wraps around a second sheave 227 that is coupled to the second moving member 225 and may wrap around any other number of sheaves positioned between the second connection member 329 and the trough 10 to help move the skate 205 along the trough 10. The second actuator 220 can be a hydraulic cylinder as shown in this embodiment, or can be another type of linear actuator or a rotary actuator, such as a winch. In any case, the second actuator 220 is flexibly coupled to the skate 205 using cables and sheaves, such as the second cable 229 and second sheave 227, another type of pulley system, and/or other similar types of connection systems.

The first and second actuators 210, 220 are configured to extend and retract the first and second moving members 215, 225, respectively, to move the skate 205 along the trough 10 via the first and second cables 219, 229. When a differential force (or pressure) exists between the first and second actuators 210, 220, the skate 305 is moved along the trough 10. In particular, when the force applied to the first cable 219 by the first actuator 210 is greater than or less than the force applied to the second cable 229 by the second actuator 220, the skate 205 is moved along the trough 10. When the forces applied to the first and second cables 219, 220 by the first and second actuators 210, 220, respectively, are equal, the skate 205 remains stationary.

Pressurized fluid may be supplied to the first actuator 210 to retract the first moving member 215, which pulls on the first cable 219 to move the skate 205 along the trough 10 in a first direction. At the same time, the second moving member 225 may be extended from the second actuator 220 such that the first and second cables 219, 229 are maintained in tension as the skate 205 is moved along the trough 10 in the first direction. When moving in the first direction, the skate 205 may be pushing a pipe along the trough 10. When the skate 205 is pushing the pipe, the clamping assembly 300 may be actuated into an open position.

Similarly, pressurized fluid may be supplied to the second actuator 220 to retract the second moving member 225, which pulls on the second cable 229 to move the skate 205 along the trough 10 in a second, opposite direction. At the same time, the first moving member 215 may be extended from the first actuator 210 such that the first and second cables 219, 229 are maintained in tension as the skate 205 is moved along the trough 10 in the second, opposite direction. When moving in the second direction, the skate 205 may be pulling the pipe along the trough 10. When the skate 205 is pulling the pipe, the clamping assembly 300 may be actuated into a clamped position to clamp the pipe to the skate 205.

Figure 4:
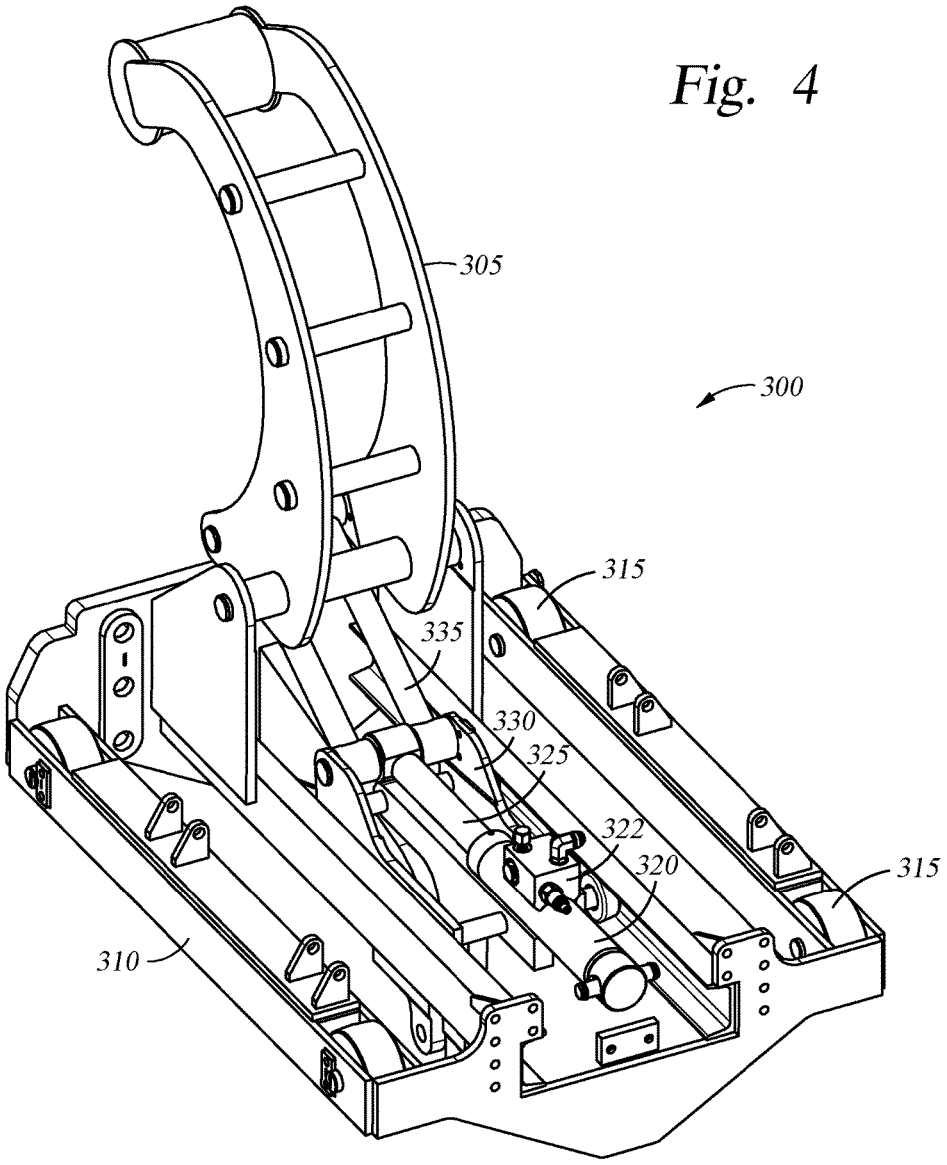
FIG. 4 shows a first perspective view from above of a skate with a clamping assembly shown in an open position.
Figure 5:
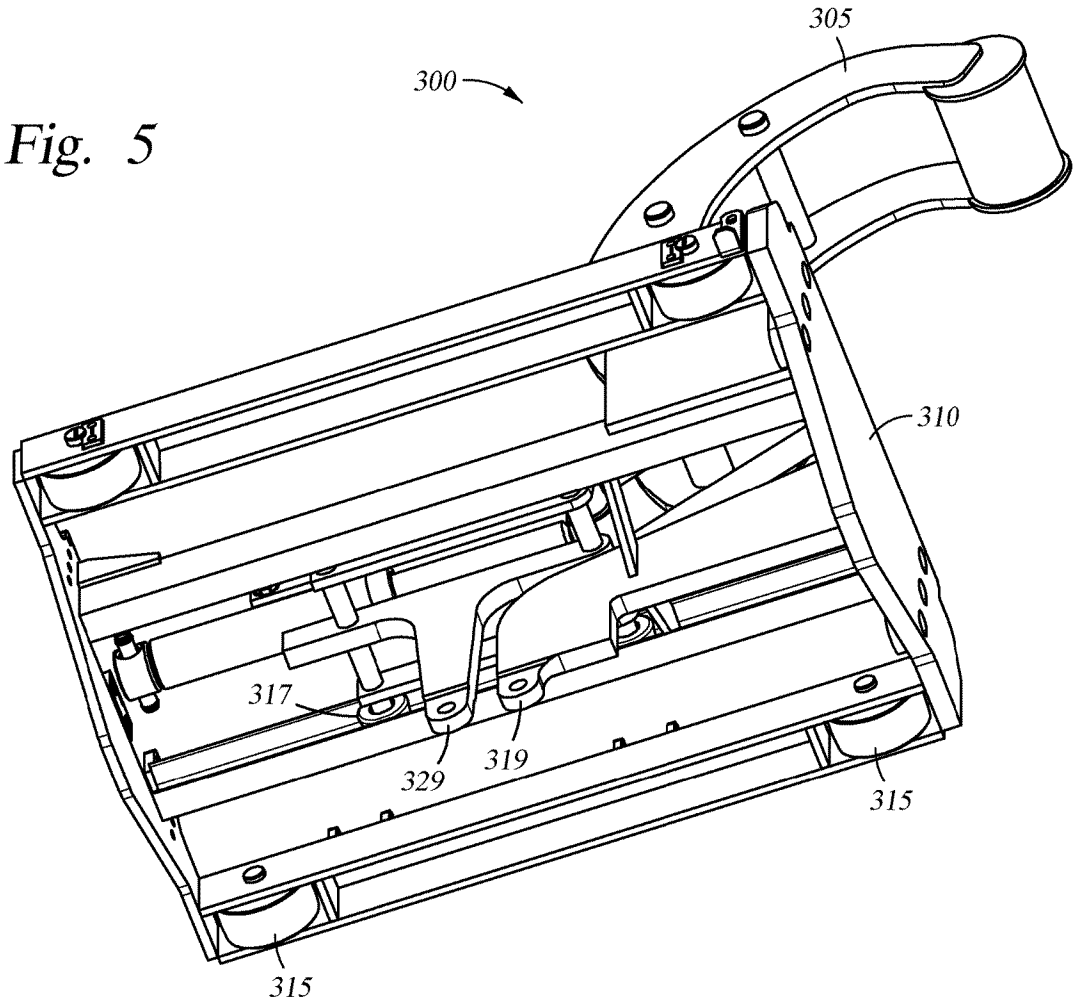
FIG. 5 shows a second perspective view from below of the skate with the clamping assembly in the open position.
Figure 6A:
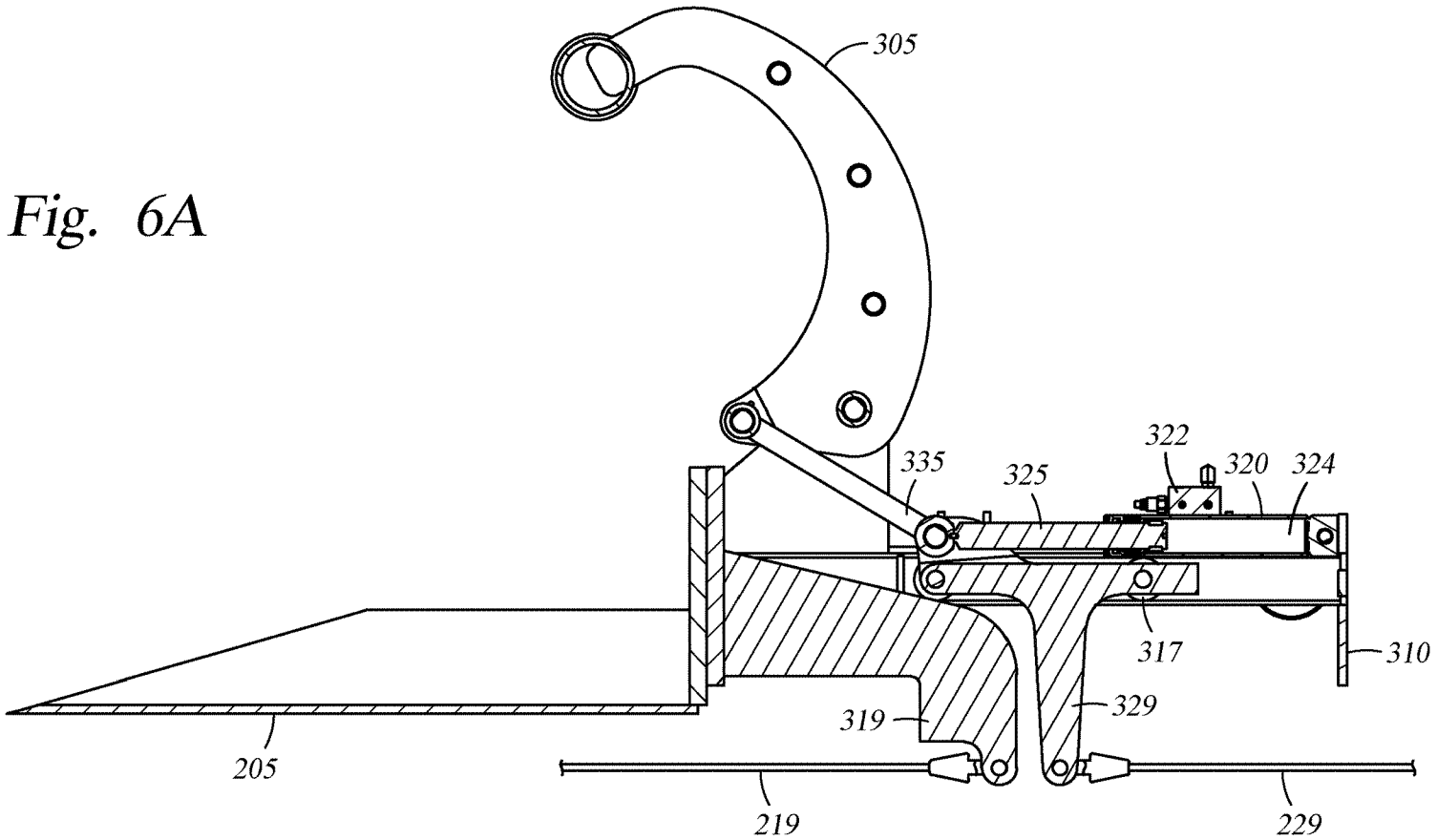
FIG. 6A shows a cross section of the skate with the clamping assembly in the open position.
Figure 6B:
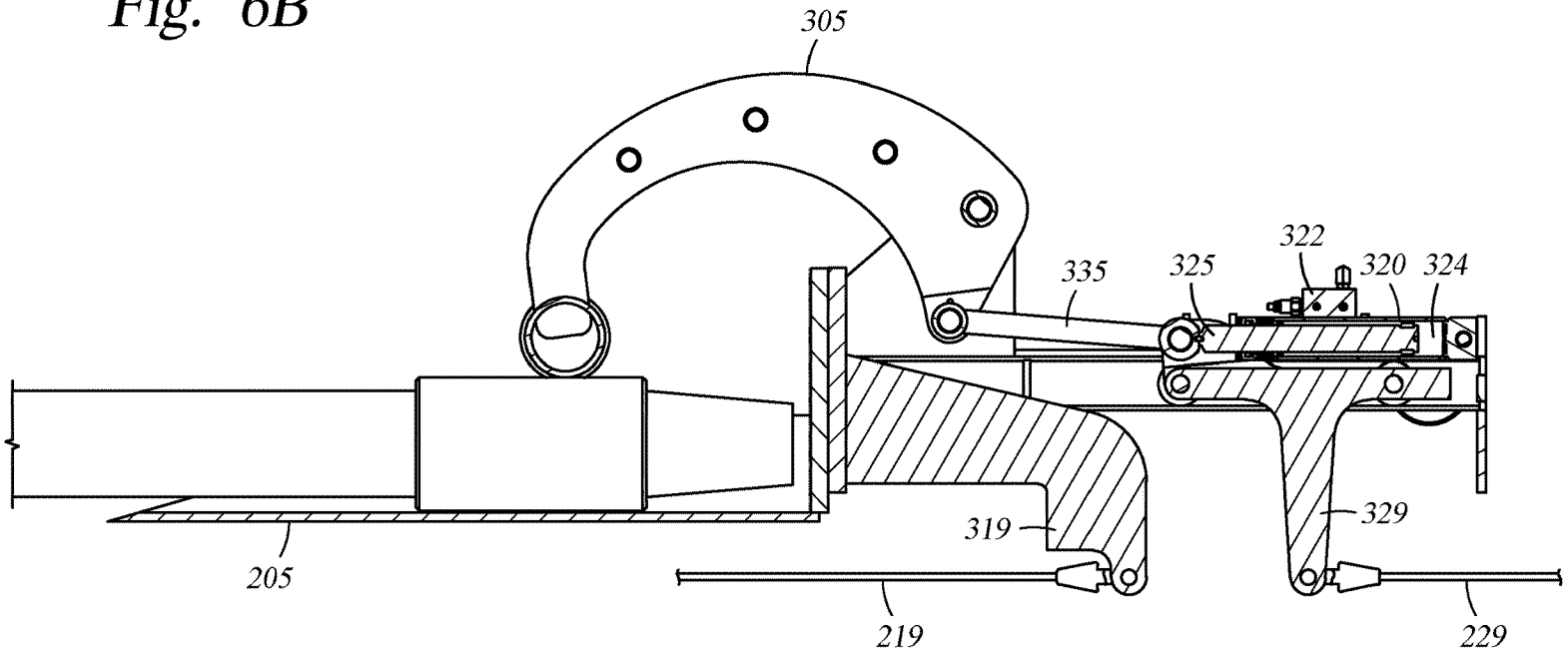
FIG. 6B shows a cross section of the skate with the clamping assembly in a clamped position.

FIGS. 4 and 5 show perspective views of the clamping assembly 300 in an open position. FIG. 6A shows a cross section of the skate 205 with the clamping assembly 300 in the open position. FIG. 6B shows a cross section of the skate 205 with the clamping assembly 300 in a clamped position. Some of the components of the clamping assembly 300 have been removed for clarity.

Referring to FIGS. 4, 5, 6A, and 6B, the clamping assembly 300 includes a clamp 305 pivotably coupled to a skate frame 310 having one or more rollers 315 configured to roll along the trough 10 during operation. The first connection member 319 is also coupled to the skate frame 310. The skate 205 is also coupled to the skate frame 310 adjacent to the clamp 305.

The clamping assembly 300 further includes a biasing device 320, shown as a hydraulic cylinder, coupled to the skate frame 310 and having a third moving member 325, such as a rod, that is retracted into and extended from the biasing device 320. In an alternative embodiment, the biasing device 320 may be or include a passive spring or a spring-and-damper device. The third moving member 325 is coupled to the clamp 305 by one or more connecting rods 335. The third moving member 325 and the connecting rods 335 are each coupled to an actuating carriage 330 having one or more rollers 317 configured to roll along rails located within the skate frame 310. The second connection member 329 is also coupled to the actuating carriage 330.

Referring to FIG. 6A, the first cable 219 is coupled to the first connection member 319, which is coupled to the skate frame 310, and the second cable 229 is coupled to the second connection member 329, which is coupled to the actuating carriage 330. A force may be applied to the first connection member 319 via the first cable 219 that is greater than a force applied to the second connection member 329 via the second cable 229 (due to a differential pressure between pressures within the first and second actuators 210, 220) that moves the skate 205 along the trough 10 in a first direction. Similarly, a force may be applied to the second connection member 329 via the second cable 229 that is greater than a force applied to the first connection member 319 via the first cable 219 (due to a differential pressure between pressures within the second and first actuators 220, 210) that moves the skate 205 along the trough 10 in a second, opposite direction. The cables 219, 229 are maintained in tension as the skate 205 is moved in both the first and second directions along the trough 10.

As the skate 205 is moved in the first direction, and although the first and second cables 219, 229 remain in tension, the biasing device 320 may maintain the clamp 305 in the open position. In particular, pressurized fluid may be supplied through a valve 322 into a chamber 324 of the biasing device 320, such as by an accumulator 323 shown in FIGS. 3A and 3B, to force the third moving member 325 to extend out from the biasing device 320. The valve 322 and the accumulator 323 may be coupled to the skate frame 310.

As the third moving member 325 is moved out of the biasing device 320, the connecting rods 335 are moved to pivot the clamp 305 to the open position. When the tension between the first and second cables 219, 229 is less than the force applied by the biasing device 320 to the clamp 305 (referred to as a clamping threshold force), the clamp 305 is maintained in the open position. The clamp 305 is maintained in the open position until a tension force applied to the first and second cables 219, 229 exceeds and is greater than the force applied to the clamp 305 by the biasing device 320.

Referring to FIG. 6B, a force may be applied to the second connection member 329 via the second cable 229 and to the first connection member 319 via the first cable 219 to generate a tension force in the first and second cables 219, 229 that is greater than the clamping threshold force applied by the biasing device 320. The tension force applied to the first and second cables 219, 229 pulls the second connection member 329 away from the first connection member 319, such that the actuating carriage 330 moves relative to the skate frame 310 and forces the third moving member 325 to retract into the biasing device 320 against the force of the pressurized fluid in the chamber 324. The pressurized fluid in the chamber 324 may flow out through the valve 322 back into the accumulator 323 (shown in FIG. 3A). As the third moving member 325 is retracted, the connecting rods 335 are also moved with the actuating carriage 330 to pivot the clamp 305 to the clamped position to engage and clamp a pipe 5 to the skate 205.

The pressure within the biasing device 320 (maintained by the accumulator 323) may be used to set the clamping threshold force necessary to actuate the clamping assembly 300 from the open position to the clamped position. The tension force in the first and second cables 219, 229 must be greater than the clamping threshold force to retract the third moving member 325 and move the clamp 305 to the clamped position. When the tension force in the first and second cables 219, 229 is less than the clamping threshold force, the pressurized fluid in the accumulator 323 flows back into the chamber 324 of the biasing device 320 to extend the third moving member 325 back out of the biasing device 320 and thereby move the clamp 305 to the open position. In this manner, the clamping assembly 300 is remotely actuatable during operation.

While the foregoing is directed to some embodiments, other and further embodiments may be devised without departing from the basic scope thereof, and the scope thereof is determined by the claims that follow.

The invention claimed is:

1. A skate drive and tubular clamping system for a catwalk, comprising:

a skate configured to move a tubular along a trough of the catwalk;

a clamp coupled to the skate and configured to clamp the tubular to the skate;

a first actuator having a first moving member coupled to a first connection member of the skate by a first cable;

a second actuator having a second moving member coupled to a second connection member of the skate by a second cable, wherein the first and second actuators are configured to extend and retract the first and second moving members to move the skate and the clamp via the first and second connection members and cables along the trough; and a biasing device having a third moving member coupled to the clamp, wherein the third moving member is extended from and retracted into the biasing device to move the clamp between an open position and a clamped position based on a tension force applied between the first and second cables and a clamping threshold force applied to the clamp by the biasing device.

2. The system of claim 1, wherein clamp is moved to the open position when the tension force applied to the first and second cables is less than the clamping threshold force.

3. The system of claim 1, wherein clamp is moved to the clamped position when the tension force applied to the first and second cables is greater than the clamping threshold force.

4. The system of claim 1, wherein the third moving member is coupled to the clamp by one or more connecting rods configured to pivot the clamp between the open and clamped positions.

5. The system of claim 1, wherein the clamp is moved to the clamped position when the third moving member is retracted into the biasing device.

6. The system of claim 1, wherein the clamp is moved to the open position when the third moving member is extended from the biasing device.

7. The system of claim 1, wherein the third moving member is extended from the biasing device by a force that biases the clamp in the open position.

8. The system of claim 1, wherein the biasing device is pressurized to extend the third moving member from the biasing device.

9. The system of claim 8, wherein the biasing device further includes a cylinder and an accumulator configured to supply pressurized fluid to the cylinder to extend the third moving member from the cylinder.

10. The system of claim 1, wherein the third moving member is retracted to move the clamp to the clamped position when the tension force applied to the first and second cables by the first and second actuators exceeds the clamping threshold force applied to the clamp by the biasing device.

11. The system of claim 1, wherein the biasing device further includes a cylinder and the third moving member includes a rod coupled to the clamp, and wherein pressurized fluid supplied into a chamber of the cylinder extends the rod from the cylinder to move the clamp to the open position.

12. The system of claim 1, wherein the first connection member is coupled to a frame of the skate having one or more rollers configured to roll along the trough, and wherein the second connection member is coupled to an actuating carriage having one or more rollers configured to roll along the frame of the skate.

13. The system of claim 1, wherein the clamp is biased into the open position by the biasing device.

14. A method of remotely and independently operating a skate drive and tubular clamping system, comprising:

actuating at least one of first and second actuators to generate a differential force between the first and second actuators to move a skate along a trough of a catwalk, wherein the first and second actuators are coupled to the skate by first and second cables;

moving a clamp to an open position by applying a clamping threshold force to the clamp by a moving member that is extended from a biasing device; and moving the clamp from the open position to a clamped position to clamp a tubular to the skate when a tension force applied to the first and second cables exceeds the clamping threshold force to retract the moving member into the biasing device.

15. The method of claim 14, wherein the biasing device further includes a cylinder such that the moving member is extended from the cylinder by pressurized fluid in the cylinder to move the clamp to the open position.

16. The method of claim 15, wherein when the tension force applied to the first and second cables exceeds the clamping threshold force, the moving member is retracted into the cylinder to move the clamp to the clamped position.

17. The method of claim 14, further comprising moving the skate in a first direction to push the tubular along the trough when the clamp is in the open position.

18. The method of claim 17, further comprising moving the skate in a second, opposite direction to pull the tubular along the trough when the clamp is in the clamped position.

19. A skate drive and tubular clamping system for a catwalk, comprising:

a skate configured to move a tubular along a trough of the catwalk;

a clamp coupled to the skate and configured to clamp the tubular to the skate;

a first actuator having a first moving member coupled to a first connection member by a first cable, wherein the first connection member is coupled to a frame of the skate having one or more rollers configured to roll along the trough;

a second actuator having a second moving member coupled to a second connection member by a second cable, wherein the second connection member is coupled to an actuating carriage having one or more rollers configured to roll along the frame of the skate, and wherein the first and second actuators are configured to extend and retract the first and second moving members to move the skate and the clamp via the first and second connection members and cables along the trough; and a biasing device coupled to the clamp and configured to move the clamp between an open position and a clamped position based on a tension force applied between the first and second cables and a clamping threshold force applied to the clamp by the biasing device.

* * * * *